US008814497B2

(12) United States Patent
Schmidt et al.

(10) Patent No.: US 8,814,497 B2
(45) Date of Patent: Aug. 26, 2014

(54) SWITCHABLE COOLANT PUMP

(75) Inventors: Eugen Schmidt, Merbelsrod/Thueringen (DE); Andreas Schmidt, legal representative, Schwarzbach (DE); Franz Pawellek, Lautertal (DE)

(73) Assignee: Geraete- und Pumpenbau GmbH Dr. Eugen Schmidt, Merbelsrod/Thueringen (DE)

( * ) Notice: Subject to any disclaimer, the term of this patent is extended or adjusted under 35 U.S.C. 154(b) by 521 days.

(21) Appl. No.: 13/266,133

(22) PCT Filed: Apr. 30, 2009

(86) PCT No.: PCT/DE2009/000618

§ 371 (c)(1), (2), (4) Date: Oct. 25, 2011

(87) PCT Pub. No.: WO2010/124664

PCT Pub. Date: Nov. 4, 2010

(65) Prior Publication Data

US 2012/0107121 A1 May 3, 2012

(51) Int. Cl.

| | |
|---|---|
| ***F04D 15/00*** | (2006.01) |
| ***F04D 29/58*** | (2006.01) |
| ***F04D 15/02*** | (2006.01) |
| ***F04D 13/02*** | (2006.01) |
| *F01P 7/16* | (2006.01) |

(52) U.S. Cl.

CPC ..... *F04D 13/021* (2013.01); *F04D 29/586* (2013.01); *F04D 15/0209* (2013.01); *F01P 7/162* (2013.01)

USPC ..... 415/19; 417/223; 417/316; 417/319; 417/362

(58) Field of Classification Search

CPC .... F01P 7/162; F04D 13/021; F04D 15/0209; F04D 15/0281; F05D 2260/90; F05D 2260/902; F05D 2260/904

USPC ..... 415/18, 19, 122.1, 123; 417/212, 223, 417/316, 319, 362, 364

See application file for complete search history.

(56) References Cited

U.S. PATENT DOCUMENTS

| | | | | |
|---|---|---|---|---|
| 2002/0176773 | A1 | 11/2002 | Ozawa et al. | |
| 2008/0317609 | A1 * | 12/2008 | Schmidt et al. | 417/307 |
| 2010/0284832 | A1 * | 11/2010 | Schmidt et al. | 417/307 |
| 2011/0188987 | A1 * | 8/2011 | Schmidt et al. | 415/1 |

FOREIGN PATENT DOCUMENTS

| | | |
|---|---|---|
| DE | 197 52 372 | 5/1999 |
| DE | 100 57 098 | 3/2002 |
| DE | 101 28 059 | 11/2002 |

(Continued)

OTHER PUBLICATIONS

International Search Report of PCT/DE2009/000618, Dec. 22, 2009.

*Primary Examiner* — Edward Look
*Assistant Examiner* — Juan G Flores
(74) *Attorney, Agent, or Firm* — Collard & Roe, P.C.

(57) ABSTRACT

The invention relates to a switchable coolant pump for combustion engines which is driven by a pulley, wherein the impeller can be driven switchably by the pulley by way of a friction pairing. The switchable coolant pump according to the invention, comprising a connecting flange (9) for a pressure booster (10), the flange being disposed on the pump housing (1), and a working piston (14) disposed in a working cylinder (15), is characterized, among other things, in that on/in the pump housing (1) both the pulley (3) in a pulley bearing (2) and the pump shaft (5) in a pump bearing (4) are mounted separately, and a sleeve receptacle (17) is disposed in the pump housing (1), wherein an annular channel (19) is located in the annular bottom (18) of the receptacle, and an annular piston working sleeve (21) is inserted in the sleeve receptacle (17) in the pump housing (1), and an annular piston (24) that is provided with an annular piston packing (23) is disposed displaceably in the annular piston working sleeve (21).

9 Claims, 1 Drawing Sheet

(56) References Cited

FOREIGN PATENT DOCUMENTS

| | | |
|---|---|---|
| DE | 102 35 721 | 2/2004 |
| DE | 10 2005 062 200 | 2/2007 |
| DE | 10 2006 039 680 | 2/2008 |
| DE | 10 2007 042 866 | 3/2009 |
| DE | 10 2008 039 700 | 3/2009 |
| DE | 10 2008 013 534 | 9/2009 |
| WO | WO 2005/028901 | 3/2005 |

* cited by examiner

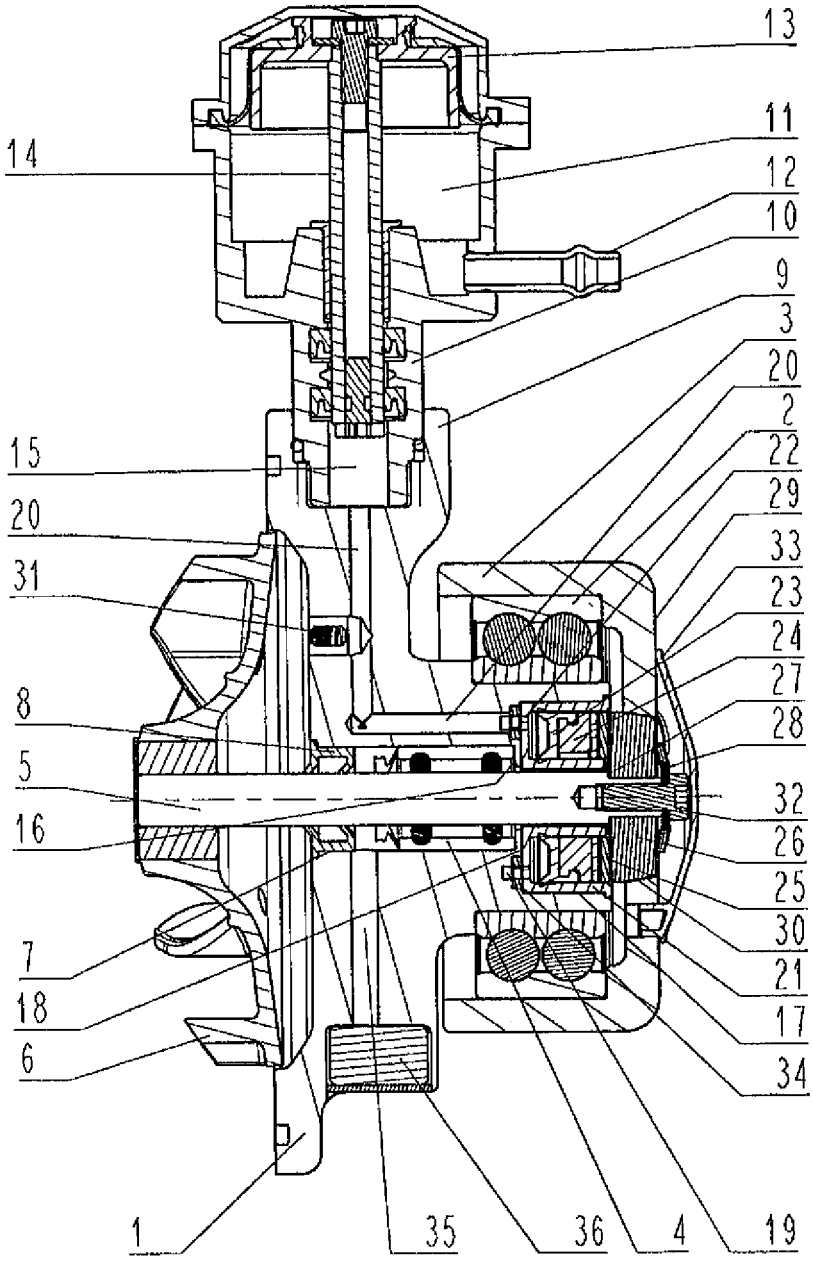
13
11
14
12
10
9
3
20
2
15
22
29
20
33
31
23
24
27
8
28
5
32
16
26
25
30
7
21
18
17
6
34
1
35
36
4
19

SWITCHABLE COOLANT PUMP

CROSS REFERENCE TO RELATED APPLICATIONS

This application is the National Stage of PCT/DE2009/000618 filed on Apr. 30, 2009, the disclosure of which is incorporated by reference. The international application under PCT article 21(2) was not published in English.

The invention relates to a switchable coolant pump for internal combustion engines, driven by way of a pulley, in which pump the impeller can be switchably driven by the pulley, by means of a friction pairing.

In the state of the art, coolant pumps for internal combustion engines are previously described, the pulleys of which are driven by the crankshaft of the internal combustion engine, and in which the impeller can be switchably connected with the pump shaft by means of a friction pairing.

The cooling output as well as the drive power of the coolant pump can be varied with the two-point regulation that can be implemented with these coolant pumps. The two-point regulation of these coolant pumps for motor vehicles makes it possible that compulsory cooling that starts immediately when the engine is started can be avoided, thereby reducing the warm-up phase of the engine, with all the disadvantages that occur during this phase, such as increased friction losses, increased emission values, and increased fuel consumption, for example.

A proven switchable coolant pump was presented by the applicant in the patent DE 100 57 098 C1, in which pump a magnetic coil is disposed in the pump housing, in stationary manner, which coil can enter into an active connection with an armature disk disposed on the drive shaft, so as to rotate with it but be displaceable under spring force, provided with a friction coating on the impeller side, in such a manner that when the magnetic field is turned off, the impeller, which is disposed on the drive shaft so as to rotate, is entrained by the armature disk, as a result of the friction pressure force.

Because the entrainment friction moment is limited, in this construction, by the magnetic construction space that is available, this solution was consistently developed further.

The patent DE 102 35 721 B4 that builds on the aforementioned solution describes a construction-space-optimized switchable coolant pump, having a clearly increased drive torque that can be transferred from the friction disk of the magnetic clutch to the impeller.

This increased drive torque is brought about by means of an increase in the contact pressure force, which results from the fact that a partial vacuum that supports the contact pressure force is built up between the friction disk and the impeller, by means of an inflow ring and an outflow ring for the cooling medium, and, at the same time, the friction disk has the pressure of the cooling medium applied to it, during operation, by means of overflow openings, on the clutch side.

These aforementioned construction forms of coolant pumps are switched off during cold start of the engine, in order to guarantee engine warm-up during a short time, with all the advantages that result from this.

Once the engine has reached its operating temperature, the friction clutch in question is activated, and the coolant pump is turned on.

However, in order to minimize the wear at the torque transfer surfaces, very great contact pressure forces are required, whereby necessarily, a compromise always has to be found between a slip that is just barely permissible (i.e. the wear) and the required construction size, with the related technical effort.

In many individual cases, however, limits are set for the permissible construction sizes, in such a manner that even the construction-space-optimized construction forms of the state of the art are still too large in size.

A representative of such small coolant pumps, in which the distance between the pulley and the impeller is less than 15 mm, and the diameter of the pulley is less than 50 mm, is shown in US 2002/0176773 A1.

Furthermore, in DE 101 28 059 C1, a coolant pump disclosed by the applicant is previously described, in which a shaft rigidly connected with the pulley is double-mounted. A sleeve is disposed on this shaft, lying opposite the pulley, by means of an escapement mechanism. The impeller is disposed on this sleeve, so as to rotate with it. If necessary, the sleeve, and with it the impeller rigidly connected with the sleeve, can be additionally driven by means of a rotor of an electric motor disposed in the pump housing and rigidly connected with the sleeve, so that even in the case of traffic jams on winter highways, for example, optimal heating of the passenger compartment can be guaranteed despite a low speed of rotation of the pump shaft.

Furthermore, a coolant pump was also presented by the applicant in DE 10 2005 062 200 B3, in which pressure lines are connected with a ring channel and in which a ring piston provided with a rolled, folded covering was disposed.

The invention is therefore based on the task of developing a switchable coolant pump for internal combustion engines that can be produced in cost-advantageous and simple manner, in terms of production technology, that is driven by way of a pulley, in which pump the impeller can be switchably driven, in connection with a friction pairing, which pump is characterized by a high degree of effectiveness, a very compact, simple, robust construction form, a minimal production and assembly effort, as well as great operational safety and reliability, and which is particularly suitable for small coolant pumps (i.e. coolant pumps in which the distance between the pulley and the impeller is less than 15 mm and whose pulley diameter is smaller than 50 mm), whereby the high contact pressure forces of the newly to be developed construction form are supposed to make it possible to implement almost wear-free ON/OFF operation, in order to thereby reliably reduce the warm-up phase of the engine and to lower not only the pollutant emission but also the friction losses and the fuel consumption, whereby it should be possible to retrofit the newly to be developed switchable coolant pump even into engine families that are already in operation.

According to the invention, this task is accomplished by means of a switchable coolant pump according to the characteristics of the main claim of the invention.

Advantageous embodiments, details, and characteristics of the invention are evident from the dependent claims as well as from the following description of the solution according to the invention, in connection with the drawing of an exemplary embodiment of the present solution according to the invention.

In FIG. 1, one of the possible construction forms of the switchable coolant pump according to the invention is shown in a side view, in section, in the "off" working position (i.e. no entrainment of the impeller).

This construction form, shown in FIG. 1, is used in connection with a partial vacuum regulation.

In the following, the switchable coolant pump according to the present invention will be explained in greater detail using the exemplary embodiment shown in FIG. 1.

According to the invention, separately, a pulley 3 is mounted in a pulley bearing 2, on/in the pump housing 1, on the one hand, and a pump shaft 5 is mounted in the same pump housing 1, in a pump bearing 4 (independent of the pulley 3), on the other hand.

An impeller 6 is disposed on the free, flow-side end of the pump shaft 5, so as to rotate with it.

A shaft sealing ring 8 is disposed between the impeller 6 and the pump bearing 4, in the pump housing 1, in a seal accommodation 7.

Furthermore, a connection flange 9 for connecting a pressure intensifier 10 is disposed on the pump housing 1. An activation cylinder 11, having a pressure connection nozzle 12 disposed on this activation cylinder 11, to which nozzle a partial vacuum is applied, is disposed on this pressure intensifier 10.

An activation piston 13 is disposed in the activation cylinder 11, which piston is rigidly connected with a working piston 14 disposed in a working cylinder 15.

According to the invention, a sleeve accommodation 17 is disposed in the pump housing 1, adjacent to the bearing seat 16 of the pump bearing 4, on the pulley side, into which accommodation the free end of the pump shaft 5, on the pulley side, projects, and in the ring bottom 18 of which a ring channel 19 is disposed.

It is characteristic that the working cylinder 15 is connected with the ring channel 19 by way of multiple pressure lines 20 disposed in the pump housing 1 and connected with one another.

It is furthermore essential to the invention that a ring piston working sleeve 21 is inserted in the sleeve accommodation 17 disposed in the pump housing 1, in the bottom of which sleeve flow-through openings 22 to the ring channel 19 are disposed.

It is also essential to the invention that a ring seal 34 provided with flow-through openings 22 is disposed between the ring piston working sleeve 21 and the ring channel 19.

It is also in accordance with the invention that a ring piston 24 provided with a ring piston seal 23 is disposed in the ring piston working sleeve 21, adjacent to the flow-through openings 22 to the ring channel 19, in displaceable manner.

According to the invention, the ring piston seal 23 is tied into a related entrainment groove disposed on the ring piston 24.

It is also essential to the invention that an axial bearing 25, in the construction form of an axial needle bearing, is disposed between the ring piston 24 and a working cone 26 disposed on the pump shaft 5, in axially displaceable manner, adjacent to the ring piston 24 on the pulley side.

It is also characteristic that an end position restriction 27 for the working cone 26 is disposed on the pump shaft 5, and a reset spring 28 is disposed between the working cone 26 and the pump shaft 5.

It is advantageous if the reset spring 28, as shown in FIG. 1, is a plate spring that is braced against the working cone 26, with its face side, on the pump shaft 5, by means of an attachment screw 32.

It is essential to the invention, in this connection, that an entrainment cone 30 is disposed centrally in the face side 29 of the pulley 3 that is mounted on the pump housing 1 so as to rotate, which cone, when a partial vacuum is applied at the pressure connection nozzle 12, brings about the result that the working piston 14 acts on the working medium situated in the working cylinder 15, i.e., in the exemplary embodiment, on the cooling fluid, which is composed predominantly of a water/glycol mixture, so that the working cone 26 disposed on the pump shaft 5 enters into an active connection with the entrainment cone 30 disposed in the pulley 3, and therefore the pump shaft 5, with the impeller 6, which is rigidly connected with this pump shaft 5, is entrained by the pulley.

The present solution, as a result of the arrangement according to the invention, brings about very great contact pressure forces, which then allow slip-free and therefore wear-free ON/OFF operation.

Thus, it becomes possible, by means of the arrangement according to the invention as presented, to reliably and clearly reduce the warm-up phase of the engine, in order to lower not only the pollutant emission but also the friction losses and the fuel consumption during the warm-up phase of the engine.

The present solution is characterized, in this connection, by a very compact, simple, and robust construction form, which is particularly well suited for very small coolant pumps (i.e. coolant pumps in which the distance between the pulley and the impeller is less than 15 mm and whose pulley diameter is smaller than 50 mm).

Furthermore, by means of the solution according to the invention, very great operational safety and reliability can be guaranteed, at minimal production and assembly effort.

Because of its construction-space-optimized construction form, the present solution of a switchable coolant pump according to the invention can also be retrofitted into engine families that are already in operation.

Because of the fact that the working medium situated not only in the working cylinder 15, in the pressure line(s) 20, in the ring channel 19, and in the ring piston working space is the cooling fluid, a refill valve 31 can be disposed between the pressure line 20 and the pump chamber, as shown in FIG. 1, according to the invention, which valve guarantees equalization of leakage losses without problems, in very reliable and also cost-advantageous manner.

It is furthermore advantageous that a cover cap is disposed on the pulley 3, on the face side, which cap covers the region of the entrainment cone 30 and the working cone 26 that enters into an active connection with it, as well as its reset spring 28 and its attachment to the pump shaft 5, and thereby guarantees a high level of functional, operational, and working safety.

It is also advantageous that a leakage line 35 is disposed in the pump housing 1, close to the shaft sealing ring 8, which "keeps" the pump bearing 4 "dry" and is closed off toward the "outside" by means of a leakage sponge 36. The present solution makes optimal warm-up of the engine possible, while allowing a simple and very compact construction form, by means of defined control of the coolant transport amount, at great operational safety and reliability, with minimal production and assembly effort.

With the solution according to the invention presented here, it is possible, after the engine has warmed up, to influence the engine temperature in ongoing operation in such a manner that not only the pollutant emission, but also the friction losses and also the fuel consumption are clearly reduced, in the entire working range of the engine.

In this connection, the solution according to the invention also makes it possible that the switchable coolant pump according to the invention, which is presented here, can be retrofitted even into engine families that are already being produced at this time.

REFERENCE SYMBOL LIST

1 pump housing
2 pulley bearing
3 pulley
4 pump bearing
5 pump shaft
6 impeller
7 seal accommodation

8 shaft sealing ring
9 connection flange
10 pressure intensifier
11 activation cylinder
12 pressure connection nozzle
13 activation piston
14 working piston
15 working cylinder
16 bearing seat
17 sleeve accommodation
18 ring bottom
19 ring channel
20 pressure line
21 ring piston working sleeve
22 flow-through opening
23 ring piston seal
24 ring piston
25 axial bearing
26 working cone
27 end position restriction
28 reset spring
29 face side
30 entrainment cone
31 refill valve
32 attachment screw
33 cover cap
34 ring seal
35 leakage line
36 leakage sponge

The invention claimed is:

1. Switchable coolant pump having a pump housing (1), a pulley (3) mounted in a pulley bearing (2) on the pump housing (1), a pump shaft (5), an impeller (6) disposed on a free, flow-side end of this pump shaft (5), so as to rotate with it, a shaft sealing ring (8) disposed in a seal accommodation (7), in the pump housing (1), between the impeller (6) and a pump bearing (4), a connection flange (9) disposed on the pump housing (1), for a pressure intensifier (10) having an activation cylinder (11) and a pressure connection nozzle (12) disposed on this activation cylinder (11), an activation piston (13), a working piston (14) rigidly connected with the activation piston (13), and a working cylinder (15), whereby the working cylinder (15) is connected with the ring channel (19) by way of one/multiple pressure line(s) (20) disposed in the pump housing (1) and connected with one another, and the working piston (14) acts on a working medium situated in the working cylinder (15) as well as in the pressure line(s) (20) and in the ring channel (19), wherein separately, the pulley (3) is mounted in a pulley bearing (2), on/in the pump housing (1), on the one hand, and a pump shaft (5) is mounted in a pump bearing (4), on the other hand, and wherein a sleeve accommodation (17) is disposed in the pump housing (1), adjacent to the bearing seat (16) of the pump bearing (4), on the pulley side, into which accommodation the free end of the pump shaft (5), on the pulley side, projects, and in the ring bottom (18) of which a ring channel (19) is disposed, and wherein a ring piston working sleeve (21) is inserted in the sleeve accommodation (17) in the pump housing (1), in the bottom of which sleeve flow-through openings (22) to the ring channel (19) are disposed, and wherein a ring piston (24) provided with a ring piston seal (23) is disposed in the ring piston working sleeve (21), adjacent to the flow-through openings (22) to the ring channel (19), in displaceable manner, and wherein an axial bearing (25) is disposed between the ring piston (24) and a working cone (26) disposed on the pump shaft (5), in axially displaceable manner, adjacent to the ring piston (24) on the pulley side, and wherein an end position restriction (27) for the working cone (26) is disposed on the pump shaft (5), and a/multiple reset spring(s) (28) is/are disposed between the working cone (26) and the pump shaft (5), and wherein an entrainment cone (30) is disposed centrally in the face side (29) of the pulley (3) that is mounted on the pump housing (1) so as to rotate, which cone, when a partial vacuum or an excess pressure is applied at the pressure connection nozzle (12), enters into an active connection with the working cone (26) disposed on the pump shaft (5).

2. Switchable coolant pump according to claim 1, wherein the ring piston seal (23) is tied into a related entrainment groove disposed on the ring piston (24).

3. Switchable coolant pump according to claim 1, wherein a ring seal (34) provided with flow-through openings (22) is disposed between the ring piston working sleeve (21) and the ring channel (19).

4. Switchable coolant pump according to claim 1, wherein the axial bearing (25) is an axial needle bearing.

5. Switchable coolant pump according to claim 1, wherein the reset spring (28) is a plate spring that is braced against the working cone (26), with its face side, disposed in the pump shaft (5), by means of an attachment screw (32).

6. Switchable coolant pump according to claim 1, wherein a cover cap (33) is disposed on the pulley (3), on the face side, which cap covers the region of the entrainment cone (30) and the working cone (26) that enters into an active connection with it, as well as its reset spring (28) and its attachment to the pump shaft (5).

7. Switchable coolant pump according to claim 1, wherein a partial vacuum is applied to the pressure connection nozzles (12) of the pressure intensifier (10).

8. Switchable coolant pump according to claim 1, wherein an excess pressure is applied to the pressure connection nozzles (12) of the pressure intensifier (10).

9. Switchable coolant pump according to claim 1, wherein a leakage line (35) is disposed in the pump housing (1), close to the shaft sealing ring (8), which line is closed off toward the outside by means of a leakage sponge (36).

* * * * *